US005188562A

United States Patent [19]

Carley

[11] Patent Number: 5,188,562

[45] Date of Patent: Feb. 23, 1993

[54] ACCOUNTING DEVICE FOR SIMPLIFIED BOOKKEEPING

[75] Inventor: Michelle Carley, Livonia, Mich.

[73] Assignee: Big E-Z Bookkeeping Company, Livonia, Mich.

[21] Appl. No.: 815,830

[22] Filed: Dec. 30, 1991

[51] Int. Cl.[5] ..... B42D 15/00; B42D 12/00; B41L 3/02

[52] U.S. Cl. ..... 462/54; 283/58; 402/79; 462/17; 462/72; 462/75; 462/79; 462/80; 462/84

[58] Field of Search ..... 283/58; 462/54, 71, 462/72, 73, 74, 75, 76, 77, 78, 79, 80, 81, 82, 83, 84, 8, 17; 281/15.1; 402/79

[56] References Cited

U.S. PATENT DOCUMENTS

| | | | |
|---|---|---|---|
| 2,244,908 | 6/1944 | Finnila | 283/58 X |
| 2,734,756 | 2/1956 | Selinker et al. | 462/17 |
| 2,739,826 | 3/1956 | Triebel, Jr. | 462/17 |
| 2,840,393 | 6/1958 | Youngquist | 462/72 X |
| 2,922,661 | 1/1960 | Ayers et al. | 462/54 X |
| 3,142,496 | 7/1964 | Rideout | 462/17 |
| 3,177,010 | 4/1965 | Stroh | 462/54 |
| 3,722,922 | 3/1973 | Perez | 462/79 |
| 4,014,566 | 3/1977 | Cantrell et al. | 283/58 X |
| 4,201,402 | 5/1980 | Aziz et al. | 462/65 |
| 4,332,400 | 6/1982 | Hayman | 462/80 |
| 4,346,917 | 8/1982 | Clancy | 283/58 |

*Primary Examiner*—Paul A. Bell
*Attorney, Agent, or Firm*—Krass & Young

[57] ABSTRACT

An accounting device for simplified bookkeeping. The device comprises a spiral binder, a check ledger insertable in the divider and divided into a plurality of rows and columns for recording data thereon, as well as a plurality of snap-fit checks which overlie the ledger in shingled fashion. Each check contains a strip of transfer material so that information recorded on each check is successively transferred to a line of the check ledger. A plurality of spreadsheet forms including matchup boxes are also insertable into the binder. Sums recorded in the matchup boxes are transferable to correspondingly labeled matchup boxes provided on a profit/loss summary form so that profit or loss may be easily calculated, and bank account figures easily reconciled. All of the bookkeeping operations associated with a small or micro business may be performed using the self-contained accounting device of the present invention.

5 Claims, 5 Drawing Sheets

ACCOUNTING DEVICE FOR SIMPLIFIED BOOKKEEPING

FIELD OF THE INVENTION

This invention relates to the field of accounting devices and, more particularly, to such a device including means for simplified record keeping and designed for small businesses.

DESCRIPTION OF THE RELEVANT PRIOR ART

Some way of keeping track of incoming and outgoing amounts of cash is necessary for any business, albeit how small. In particular, even small businesses must keep accurate records of such things as disbursements, bank deposits, etc. In particular, businesses must be able to accurately determine the business profit or loss for the fiscal year, and must be able to verify the calculations involved for federal and state income tax purposes.

However, many proprietors of small and micro businesses are inexperienced at bookkeeping methods. In fact, the average person starting out in small business may have no more experience in accounting than balancing his/her own checkbook. There are, of course, various computer software programs which are designed to simplify the record keeping process necessitated by a small business. However, even such software packages may present obstacles to many small business propretors who may not be computer "literate." Furthermore, accounting software for small businesses also presents the disadvantage that all written records, such as checks, must be manually inputted into the program, a process which is not only time-consuming, but can lead to inaccuracies.

There are, of course, accounting systems and devices available which are designed to aid the small business proprietor. Some examples of prior art products are disclosed in, for example, U.S. Pat. Nos.: 3,346,917; 4,940,257; 4,400,016; 4,315,697; and 4,201,402. For example, the '402 patent describes a bookkeeping and check writing system which enables simultaneous entry of payee and numerical disbursement amount upon the check and an underlying disbursement sheet and, optionally, a duplicate sheet such as a separate voucher sheet. The system includes a shield member having an aperture formed therein coinciding with the appropriate blanks so that, when data is entered upon the check, pressure is transferred to a transfer sheet and the underlying disbursement and voucher sheets. The check shield member may be used with any type of conventional business checks.

However, none of the known prior art includes provisions for all of the accounting information necessary for a typical small business. Obviously, it would be a great advantage if a small or micro business accounting device were completely self-contained, and provided an accurate and easy way of performing double entry bookkeeping for the business owner.

SUMMARY OF THE INVENTION

Disclosed and claimed herein is an accounting device for simplified bookkeeping particularly adaptable to record keeping for small businesses. The accounting device comprises a spiral binder of conventional design having a check ledger insertable therein. The check ledger is divided into a plurality of vertically disposed columns as well as a plurality of horizontally disposed lines to create a plurality of data recording spaces thereon. A plurality of checks are provided which overlie the check ledger and are disposed in shingled fashion thereon. Each of the plurality of checks has a series of apertures formed along an end edge thereof so that the checks "snap" into the binder. A plurality of perforations are disposed proximate said end edge of each check and medially from said apertures to form a tear strip whereby each of the plurality of checks may be easily removed from the spiral binder. Each of said checks also includes a plurality of spaced data recording blanks aligned along an axis transverse said edge for recording such items as the date, the payee, the amount in numerals, the amount in writing, etc.

A strip of transfer material underlies said plurality of blanks and is, preferably, disposed on a face of the check opposite the face including said data recording blanks. The checks are disposed in the binder such that data recorded on the plurality of blanks of each successive check will transfer via the transfer strips to the spaces formed on successive lines of the check ledger. By attaching the checks to successively lower rings of the spiral binder, the checks may easily be disposed in partially overlapping, shingled fashion. The lines disposed on the check ledger are appropriately spaced to accommodate this overlapping arrangement of the checks, that is, the spacing of said lines is approximately as the spacing of the rings of the spiral binder.

The accounting device of the present invention further includes a plurality of spread sheet forms which are insertable in the binder, and each of which provides means for recording a plurality of entries pertaining to a specified category of business transaction. For example, one of such spread sheet forms may be designated to receive entries pertaining to bank deposits, another for bank reconciliation, etc. Each of said plurality of spreadsheet forms, as well as the check ledger, further includes individual, alpha-numerically labeled matchup boxes for recording sums representing a total derived from said plurality of entries for that category. The matchup boxes are for transferring figures from one form to other forms throughout the device. For example, a matchup box labeled "A" may appear at the bottom of a column labeled "Sales" included on the deposit listing spreadsheet form. A figure representing the sum of all sales entered in the "Sales" column is recorded in matchup box A. Preferably, similar matchup boxes are also included on the check register itself.

The accounting device of the present invention also includes a profit/loss summary form which is also insertable into the binder. The profit/loss summary form includes a plurality of alpha-numerically labeled matchup boxes for transferring to the summary form sums recorded in a correspondingly labeled individual matchup box from one of the spreadsheet forms or the check register. That is, the profit/loss summary form might include a matchup box labeled "A" in part of its "Income" portion for entry of the sum recorded in the correspondingly labeled matchup box A from the deposit spreadsheet form. Additionally, each matchup box has an arithmetical operator associated with it ("+," "−" or "=") so that the user will know whether to add, subtract, etc. By transferring all of the sums from the individual matchup boxes to the matchup boxes on the profit/loss summary form for a given calendar period (typically a month), the profit/loss for that calendar period may be easily determined.

Preferably, the profit/loss summary further includes two portions, one for transferring figures associated with income and expenses, and the other with figures associated with banking transactions (checks, deposits, withdrawals, etc.). After entering the appropriate figures in the matchup boxes of both portions and performing the appropriate arithmetical operations indicated beside each box, the "bottom-line" figures on both portions of the profit/loss summary may be double-checked for accuracy. The final sums derived from both portions should be identical if everything was done accurately.

Thus, the accounting device of the present invention includes everything a small business proprietor needs to keep accurate records, both for tax purposes and for normal accounting purposes. Furthermore, the device is totally self-contained, and all the necessary elements thereof are securely attached to a single, spiral binder, thus greatly minimizing the chance of loss or misplacement. Additionally, and unlike computer based accounting systems, the device is completely portable. Furthermore, the accounting device claimed herein is particularly adaptable to the standard, double-entry form of bookkeeping so that sums derived from the entries recorded therein may be easily cross-checked.

BRIEF DESCRIPTION OF THE DRAWINGS

The following detailed description may best be understood by reference to the following drawings in which.

DETAILED DESCRIPTION OF THE PREFERRED EMBODIMENTS

Figure 1:
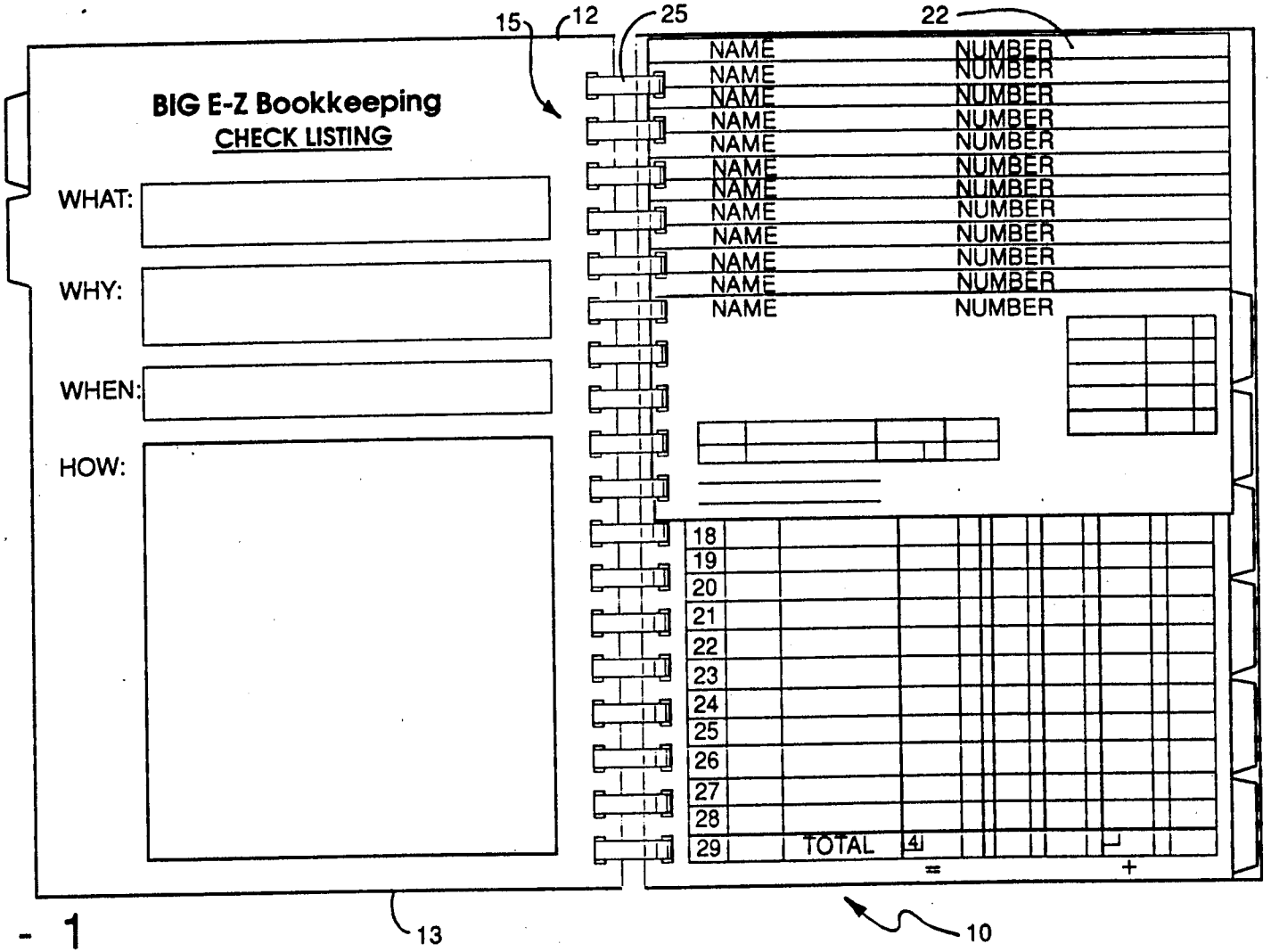
FIG. 1 is a perspective view of an accounting device incorporating the principles of the present invention, with the spiral binder thereof opened to show a plurality of checks and check register.

Throughout the following detailed description, like reference numerals are used to refer to the same element of the claimed invention shown in multiple figures thereof.

Figure 2:
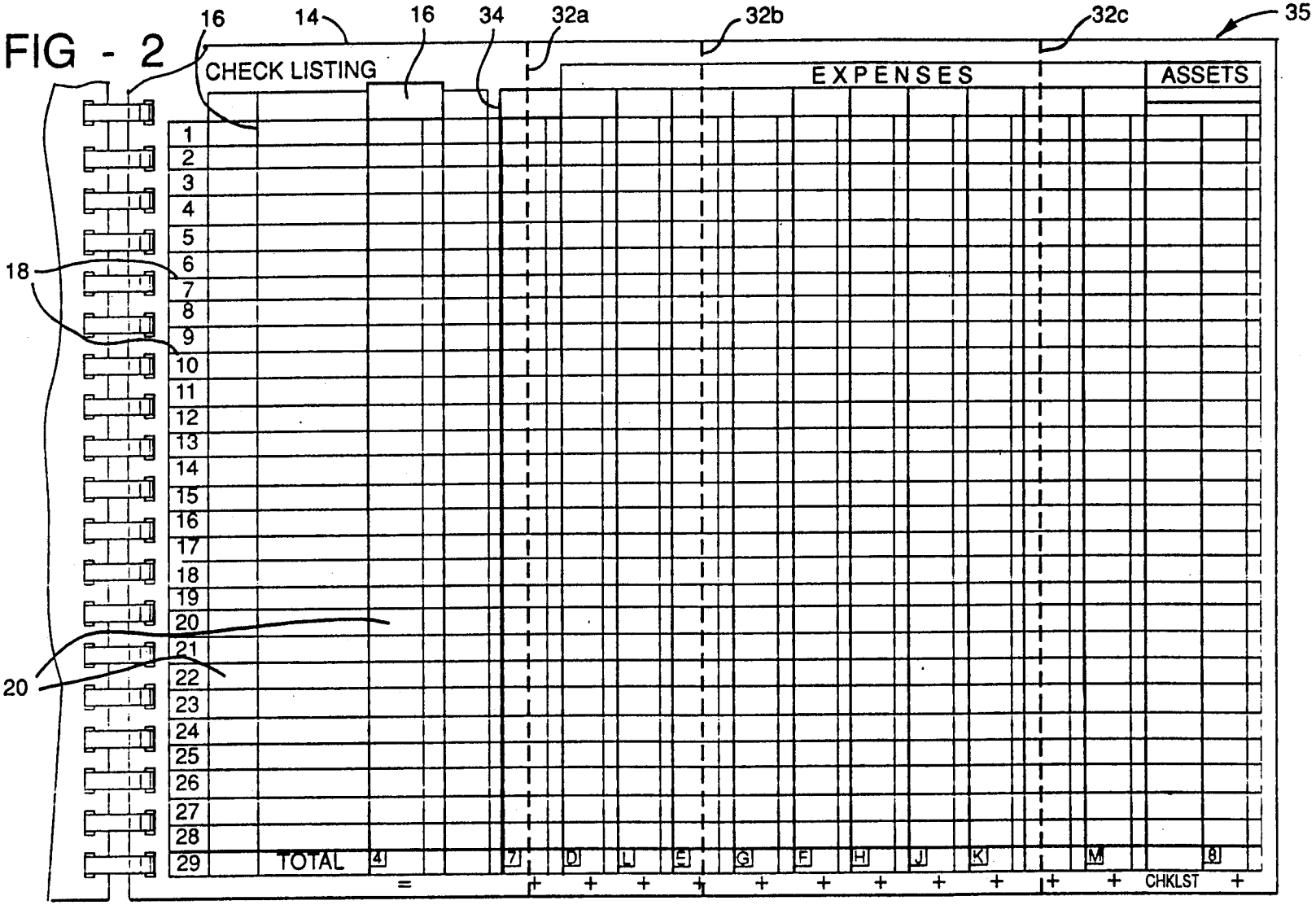
FIG. 2 illustrates the check register of FIG. 1 with the fold-out portions thereof in the folded out position.

Referring now to the drawings, and in particular to FIGS. 1 and 2, there is shown an accounting device 10 designed for simplified, double entry bookkeeping. The accounting device 10 comprises a spiral binder 12, which may be of any standard design, having covers 13 and a plastic, spiral spine 15 to which insertions in the binder 12 may be attached. A check ledger 14 is insertable in said binder. The check ledger 14 is divided into a plurality of vertically disposed columns 16 and a plurality of horizontally disposed lines 18 to create a plurality of data recording spaces 20 thereon. As is shown in FIG. 2, the spaces 20 disposed along a single line 18 may be given a corresponding number; that is, the lines are consecutively numbered down the page of the ledger 14.

Figure 3A:
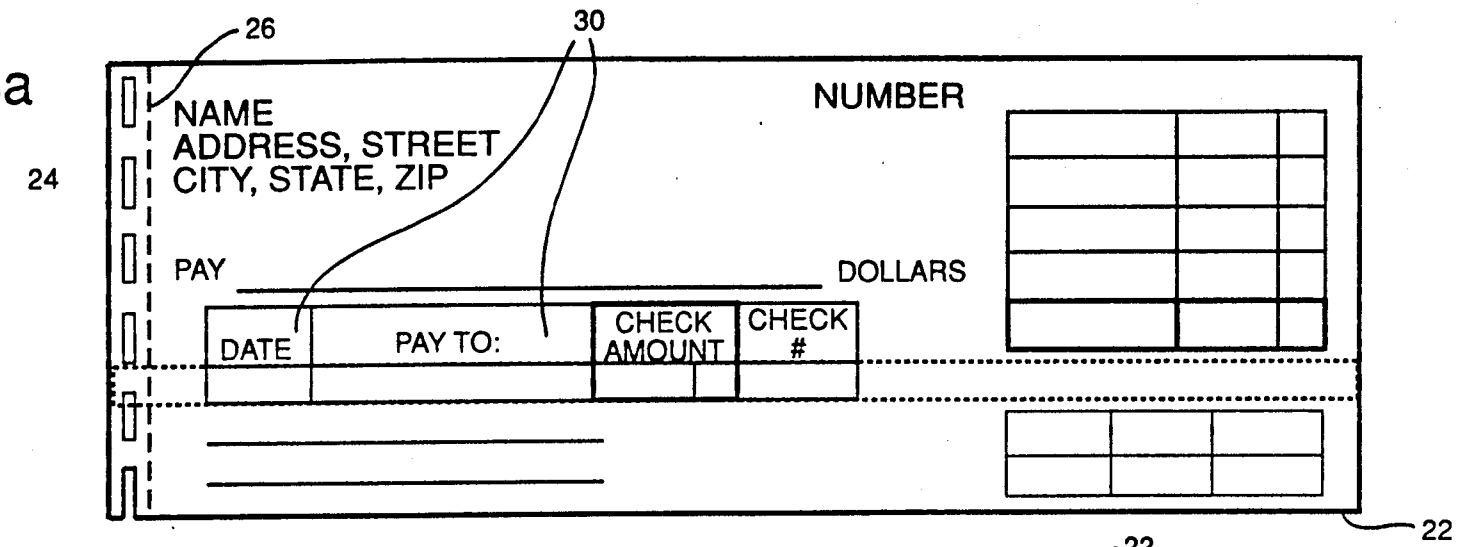
FIGS. 3A and 3B illustrate details of, respectively, the front and back surfaces of a check suitable for use with the present invention.
Figure 3B:
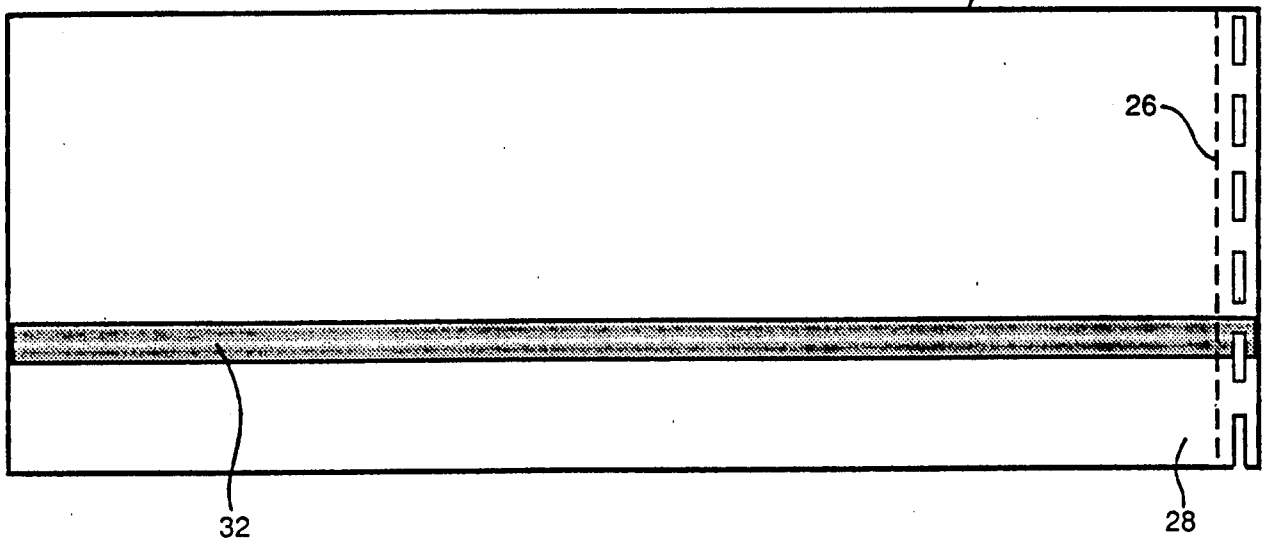

A plurality of checks 22 shown in detail in FIGS. 3A and 3B overlie the ledger 14 and are disposed in shingled fashion thereon. To this end, each of the plurality of checks 20 has a plurality of apertures 24 formed along one end edge thereof so that each check 22 may be snap fitted into the spiral binder 12 by the user. Preferably, one of the plurality of checks 22 will be snapped into the binder with its apertures 24 engaged with the topmost of the rings 25 of the spiral 15, and each successive check 22 will be stepped down one ring 25 so that the checks 22 are disposed in consecutively overlapping manner.

Each of the plurality of checks 22 further includes a plurality of perforations 26 which are formed in the check 22 proximate said end edge medially from said apertures 24. The perforations 26 form a tear strip so that each check 22 may be easily and neatly removed from the spiral binder 12.

Each of the plurality of checks 22 includes a plurality of spaced, data recording blanks 30 which are aligned along an axis A transverse said end edge. As can be seen in FIG. 3B, a strip 32 of transfer material such as carbon paper, or carbonless material, underlies the plurality of blanks 30.

As is conventional, the plurality of blanks are for the purpose of recording check information thereof, such as the date of the check, the payee, the amount of the check in numerals, etc. Because said plurality of data recording blanks 30 overlie the transverse strip 32, the data recorded in the blanks 30 will be transferred to the underlying check ledger. As is apparent from FIG. 1, the plurality of checks 22 are disposed in the spiral binder 12, and the horizontally disposed lines 18 of the check ledger 14 are spaced such that, data recorded on the plurality of blanks 30 for each successive check will transfer to the spaces 20 formed on successively numbered lines 18 of the check ledger 14.

The uppermost of the checks 22 will be the first one written upon. The plurality of data recording blanks 30 of the first check overlies the data recording spaces 20 for the first numbered line of the check ledger 14. Thus, the date of the first check, the name of the payee, the amount, etc. will be transferred to the first line of the check ledger 14 as it is written. The first check is then removed from the ledger 14. As the next uppermost check is filled out, the data recorded thereon will transfer to the second line of the check ledger 14 and so on. In this manner, a record of the information recorded on all the blanks 30 of the plurality of checks 22 will appear on successive lines of the check ledger 14. Although not shown in FIG. 1, the accounting device of the present invention preferably contains multiple sheets of checks 22, and multiple pages of the check ledger 14 as required.

Each page of the check ledger 14, preferably, can be folded out for the recordation of additional data. To that end, a plurality of vertically disposed fold lines **32*a*, 32*b*, 32*c* are provided which divide a fold-out portion 35 of the check ledger 14 into approximate thirds. The fold-out portion 35 maybe folded along the fold lines 32*a*, 32*b*, 32*c* so that the check ledger 14 will assume a configuration which does not protrude from the spiral binder 12. FIG. 2 illustrates the check ledger 14 of the present invention with its full page unfolded. Additional columns and spaces for recording information about each check may be included on the folded out portions of check ledger 14**. For example, these portions may include various categories of expenses under which each check may be classified. The provision of these additional data recording spaces facilitates the tracking of expenses, thus simplifying the bookkeeping required.

It will be noted that, in the embodiment shown in FIG. 2, the check ledger 14 is designed to permit the use of the double entry method of bookkeeping. By separately totalling the check amounts on each side of the dark, solid line 34, the sums may be checked against one another for accuracy.

When the check ledger 14 of the present invention is in its folded configuration, as is shown in FIG. 1, the data recording spaces 20 remain unobstructed by the fold-out portions so that the data transferred from each check may be recorded on the ledger 14.

Figure 4:
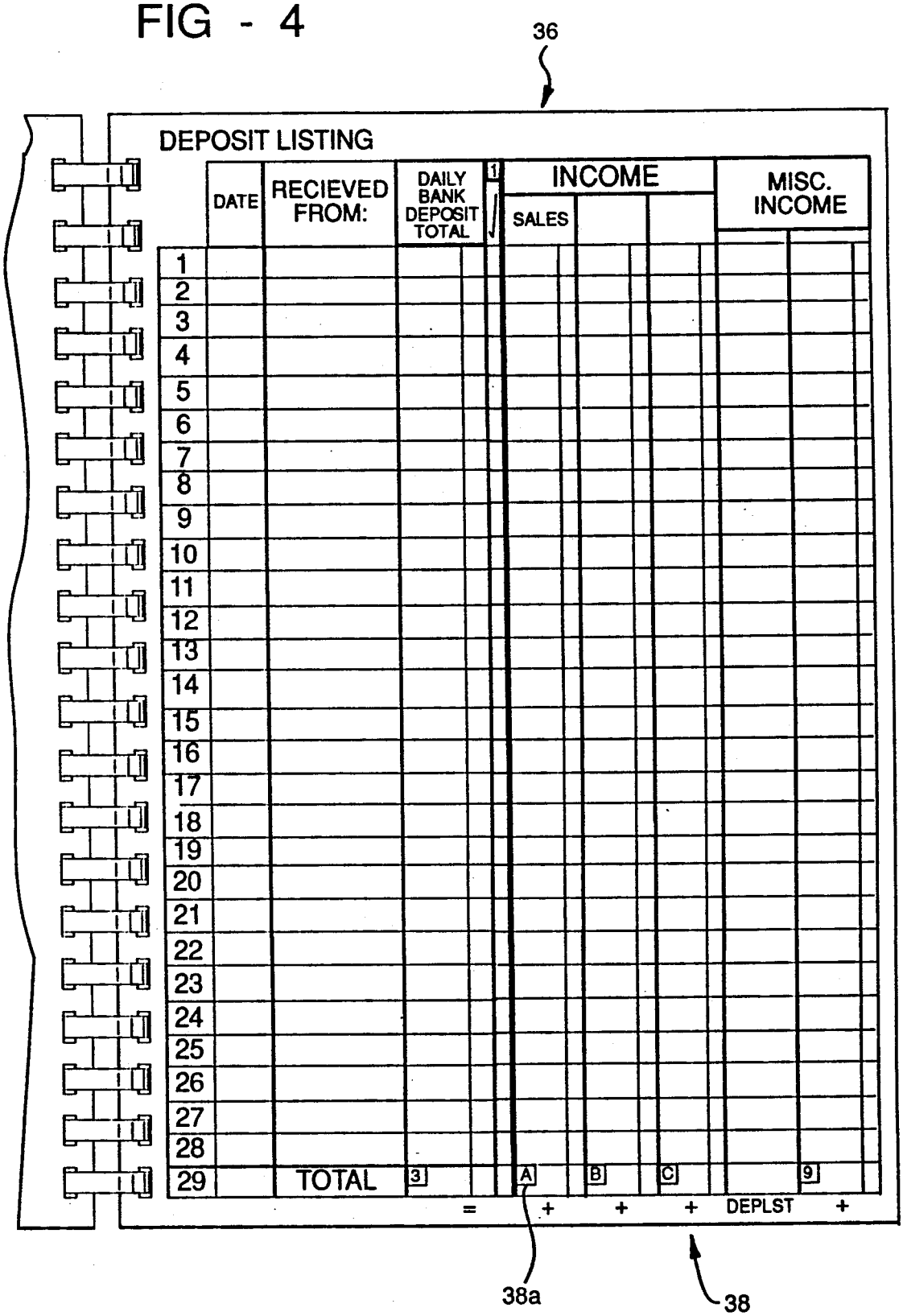
FIG. 4 illustrates a typical spreadsheet form used in practicing the present invention.

The accounting device 10 of the present invention further includes a plurality of spreadsheet forms 36, such as the example shown in FIG. 4. These spreadsheet forms are also divided into rows and columns so that a plurality of entries pertaining to a specified category of business transaction may be recorded thereon. For example, the spreadsheet form 36 shown in FIG. 4 includes spaces for recording bank deposits. Again, spaces are provided for recording the data, the payor and the amount received, as well as additional spaces for recording the category of income received. Although not illustrated, the spreadsheet form 36 may be used for the recordation of other specific financial data relating to, for example, bank reconciliation.

Each of the plurality of spreadsheet forms 36 includes labeled matchup boxes 38 which are individually alphanumerically labeled. These matchup boxes are for recording sums representing a total derived from data manipulations of a plurality of entries for a specified category of business transactions which appears on the particular spreadsheet form 36. For example, a matchup box labeled "A" may be used to record the total of the sum of all bank deposits derived from sales. Preferably, the check ledger 14 is also provided with labeled matchup boxes 38. Additionally, each matchup box 38 has associated with it (either beside or below) an arithmetical operator, such as "+," "−" or "=." The arithmetical operators indicate to the user what arithmetical operation is to be performed on the figure in the matchup box 38.

Figure 5:
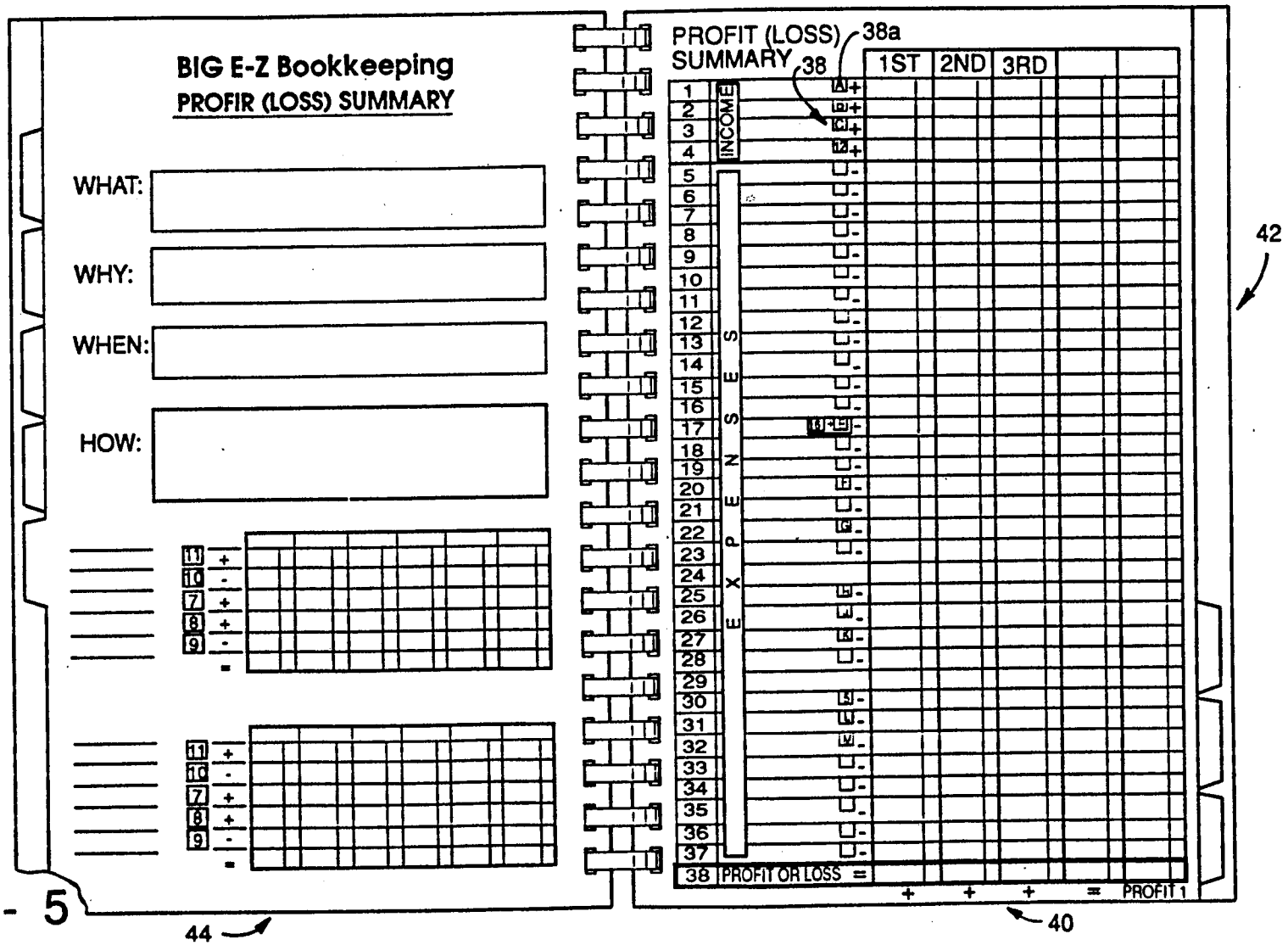
FIG. 5 illustrates a profit/loss summary form suitable for use with the present invention.

The accounting device 10 of the present invention also includes a profit/loss summary form 40 which is shown in FIG. 5. It should be noted that the illustrated device 10 is particularly designed for use by "Schedule C" filers. However, the device can easily be modified for use by corporations or to keep home budgets. Like the spreadsheet forms 36, the check ledger 14, and the plurality of checks 22, the profit/loss summary form 40 is also insertable into the spiral binder 12. The profit/loss summary form 40 is also ruled into appropriate rows and columns so that various sums may be recorded thereon. The profit/loss summary 40 also includes a plurality of alpha-numerically labeled matchup boxes 38 for transferring and recording sums recorded in correspondingly labeled matchup boxes 38 from the check ledger 14 and the spreadsheet forms 36. For example, the total sales recorded in matchup box **38*a* labeled "A" found on spreadsheet form 36 shown in FIG. 4 may be transferred to the matchup box 38*b* correspondingly labeled "A" appearing on profit/loss summary form 40 shown in FIG. 5. By transferring the sums computed and recorded in the matchup boxes 38*a* on the spreadsheet forms 36, as well as the check ledger 14, to the correspondingly labeled matchup boxes 38*b* appearing on profit/loss summary form 40**, profit/loss for a given calendar period may be easily determined. The calendar period may be monthly, quarterly, or yearly.

In the profit/loss summary 40 illustrated in FIG. 5, two sections, 42 and 44 are provided, for recordation of different types of data. For example, data pertaining to categories of income and business expenses are recorded on section 42, and items relating to financial transactions, such as bank deposits and withdrawals are recorded in appropriate spaces on section 44 of profit/loss summary 40. By performing the appropriate numerical operations on these entries, "bottom line" figures may be calculated for each portion 42,44. The bottom line figures calculated for the two portions 42,44 should match if everything has been done accurately. This serves as a double check on the calculations.

It is apparent that the accounting device 10 of the present invention takes virtually all of the guesswork out of keeping accounts and calculating profit/loss for a small business proprietor. Everything is self-contained, even the checks. Thus, the accounting device makes bookkeeping virtually fool-proof. Because the checks are self-contained in the accounting device, information about each check is automatically recorded as the check is written and the data does not have to be manually transferred, thus minimizing both effort and error. Thus, the check ledger automatically includes a complete record of checks written. Furthermore, the spreadsheet forms and profit/loss summary constitute a complete record keeping device for recording all of the figures needed to calculate profit/loss, both for .the purpose of keeping track of the business, and also for filing federal and state income tax returns. As long as the user is careful to transfer the sums recorded in the matchup boxes for the spreadsheet forms and check register to the correspondingly labeled matchup box on the profit/loss summary form, accurate calculations of profit or loss are virtually automatic.

The accounting device of the present invention provides the small business proprietor with a device which is virtually foolproof and extremely easy to use and understand. It does not require any sophisticated knowledge of either bookkeeping or computer operation. In use, it has been found that the average small business proprietor easily learns how to use the device and is able to use it to perform virtually all operations normally associated with a small business. The device of the present invention is inexpensive and easy to manufacture, and may easily be provided with self-contained, simple instructions for its use.

The accounting device of the present invention has been described with reference to certain specific embodiments and exemplifications thereof. Doubtless, variations in design may occur to one skilled in the art without departing from the scope of the present invention. For example, the illustrated device is designed for businesses who use cash based accounting methods. However, the device of the present invention could find equal applicability with accrual based systems. The present invention is not intended to be limited to the specific embodiments and exemplifications depicted, but is intended to be limited solely by the claims appended hereto and all equivalents thereof.

I claim:

1. An accounting device for simplified bookkeeping comprising:

a spiral binder;

a check ledger insertable in said binder and divided into a plurality of vertically disposed columns and a plurality of horizontally disposed lines to create a plurality of data recording spaces thereon;

a plurality of checks overlying said disposed in shingled fashion thereon, each of said checks having a plurality of apertures formed along one end edge thereof for insertion into said spiral binder and a plurality of perforations disposed proximate said edge medially from said apertures to form a tear strip, each of said checks including a plurality of spaced, data recording blanks aligned along an axis transverse said edge and a strip o transfer material underlying said plurality of blanks, said checks being disposed in said binder such that data recorded on said plurality of blanks for each successive check will transfer to the spaces formed on successive lines of said check ledger;

a plurality of spreadsheet forms insertable in said binder and each providing means for recording a plurality of entries pertaining to a specified category of business transactions;

individual, alpha-numerically labeled matchup boxes disposed on said ledger and said spreadsheet forms for recording sums representing a total derived from data manipulation of said plurality of entries for said specified categories of business transactions; and a profit/loss summary form insertable in said binder and including a plurality of alpha-numerically labeled matchup boxes for transferring sums recorded in correspondingly labeled individual matchup boxes, whereby profit/loss for a given calendar period may be easily determined.

2. The accounting device of claim 1 wherein the check ledger further includes a fold-out portion vertically divided into expense category columns so that an amount recorded for each check in one of said data recording spaces on said ledger may be transferred to an appropriate expense category column.

3. The accounting device of claim 2 wherein said folded portion is divided into approximate thirds by two vertically disposed fold lines wherein said thirds may be folded inwardly along said fold lines in overlapping manner so as not to obstruct said plurality of data recording spaces when said ledger is folded.

4. The accounting device of claim 1 wherein each matchup box has associated with it indicia indicative of a particular arithmetical operator.

5. The accounting device of claim 1 wherein the profit/loss summary is further divided into two portions, one for transfer of banking transaction sums and the other for transfer of business income and expense sums.

* * * * *

UNITED STATES PATENT AND TRADEMARK OFFICE

CERTIFICATE OF CORRECTION

PATENT NO. : 5,188,562
DATED : February 23, 1993
INVENTOR(S) : Michelle Carley

It is certified that error appears in the above-indentified patent and that said Letters Patent is hereby corrected as shown below:

Column 1, Line 30, delete "propetors" and insert --proprietors--.

Column 6, Line 28, delete "for.the" and insert --for the--.

Column 7, Line 1, delete "said disposed" and insert --said ledger and disposed--.

Column 7, Line 9, delete "o" and insert --of--.

Signed and Sealed this

Sixth Day of December, 1994

*Attest:*

*Attesting Officer*

BRUCE LEHMAN

*Commissioner of Patents and Trademarks*